US007001102B2

(12) United States Patent
Dennison

(10) Patent No.: US 7,001,102 B2
(45) Date of Patent: Feb. 21, 2006

(54) CONSTRUCTION OF ROADS

(76) Inventor: David Peter Dennison, P.O. Box 570, Link Hills, 3652,Unit No. 5 Brentwood 21 Adams Road, Pietermaritzburg (ZA) 3201

( * ) Notice: Subject to any disclaimer, the term of this patent is extended or adjusted under 35 U.S.C. 154(b) by 0 days.

(21) Appl. No.: 10/603,873

(22) Filed: Jun. 25, 2003

(65) Prior Publication Data

US 2004/0022580 A1 Feb. 5, 2004

(30) Foreign Application Priority Data

Jan. 8, 2001 (ZA) ..... 01/0188
Jan. 4, 2002 (WO) ..... 02/053840

(51) Int. Cl.
*E01C 7/00* (2006.01)

(52) U.S. Cl. ..... 404/70; 404/71; 249/188; 249/203

(58) Field of Classification Search ..... 404/17, 404/18, 27, 28, 70, 71; D25/152–156; 249/2, 249/188, 203
See application file for complete search history.

(56) References Cited

U.S. PATENT DOCUMENTS

| | | | | |
|---|---|---|---|---|
| 23,038 | A * | 2/1859 | Montgomery | 404/18 |
| 181,392 | A * | 8/1876 | Baird | 404/70 |
| 985,035 | A * | 2/1911 | Hotchkiss | 249/9 |
| 3,238,682 | A * | 3/1966 | Tracy et al. | 404/18 |
| 4,111,585 | A * | 9/1978 | Mascaro | 404/70 |
| 4,417,828 | A * | 11/1983 | de Winter | 405/70 |
| 4,601,150 | A * | 7/1986 | Dougherty | 52/309.12 |
| 5,250,340 | A | 10/1993 | Bohnhoff | 428/99 |
| 5,447,004 | A * | 9/1995 | Vrnak | 52/387 |

FOREIGN PATENT DOCUMENTS

| | | |
|---|---|---|
| GB | 239014 | 9/1925 |
| GB | 383848 | 11/1932 |
| GB | 388512 | 3/1933 |

OTHER PUBLICATIONS

Copy of the Internation Search Report mailed May 16, 2002. WO 02/053840.

* cited by examiner

*Primary Examiner*—Gary S. Hartmann
(74) *Attorney, Agent, or Firm*—Welsh & Katz, Ltd.

(57) ABSTRACT

The invention relates to the use of stabilizing body in the construction of roads. The stabilizing body comprises a substantially rigid, planar body (20) that can be inter-engaged with other similar bodies in a configuration in which an extended, substantially planar stabilizing structure can be formed. Each stabilizing body defines a multi-cellular configuration with cells (26) defined by side walls extending from the operative top side of the body towards the operative bottom side thereof. The side walls (28) defining the cells have projecting formations (30) projecting therefrom into the cells. In use, the wearing course of a road is formed within and above a stabilizing structure formed above the base of the road, with the asphalt composition used filling the cells and being anchored to the stabilizing bodies via the projecting formations, thus forming a wearing course resistant to various different known of road failure.

16 Claims, 6 Drawing Sheets

CONSTRUCTION OF ROADS

THIS INVENTION relates to the construction of roads.

The invention relates in particular to a stabilizing body for use in the construction of roads and to a method of constructing roads utilising this stabilizing body.

When referring herein to the construction of roads, reference is made particularly to the construction of roads of the type known as asphalt roads. Also, any reference to roads must be interpreted to include a reference to any other asphalt covered surfaces, including pavements, parking areas, and the like, along which road vehicles may travel.

The construction of roads, including also the repair of roads, require the formation of a stable base upon which a final layer of material, usually a mixture of asphalt and stone particles, for forming the actual road surface, is applied. This final layer commonly is referred to as the "wearing course" of the road and is hereinafter referred to as such. Also, the mixture of asphalt and stone that forms the wearing course of a road is hereinafter merely referred to as an asphalt composition.

The stable base of a road can be formed in any one of many different ways that are already well known and as this does not form a part of the present invention, this is not described in any further detail herein. Also, the formulation of the asphalt composition that forms the wearing course, being a mixture of graded stone and asphalt, is greatly variable and generally is determined by the wear requirements of the road to be constructed.

The failure of roads can occur for various different reasons, reflective cracking and rutting being two of the most common forms of failure, although other forms of failure also are known. Reflective cracking commonly results from heavy vehicles, particularly overloaded vehicles, passing over roads, the resulting deformation of the wearing course of the roads initiating cracking of the wearing course from the operative bottom side thereof. The propagation of cracks formed, in time, causes complete road failure through break-up of the wearing course.

Rutting again results mainly from heavy vehicles passing over roads, particularly during extremely hot conditions when the wearing course has softened, the exposed top surface of the wearing course deforming to cause an uneven road surface, known as a rutted road surface. Rutting again can finally result in the wearing course breaking up, while driving along rutted road surfaces also can be extremely dangerous. Thermal cracking at the surface of a wearing course also can occur where a road is exposed to large temperature variations.

It is thus an object of this invention to provide for the construction of asphalt roads that are less exposed to failure, particularly the forms of failure above described.

According to a first aspect of this invention there is provided a stabilizing body for use in the construction of roads, which comprises a substantially rigid, planar body defining a multi-cell configuration between spaced operative top and bottom faces of the planar body, and in which the cells are defined by surrounding side walls, extending from the operative top face side of the body towards the operative bottom face side of the body, of which at least some have at least one anchoring formation for anchoring an asphalt composition with respect to the respective side walls when contained in the associated cells.

It is particularly envisaged that all the side walls that define cells will have at least one anchoring formation, each anchoring formation typically comprising a projecting formation projecting from its side wall into the associated cell.

The side walls preferably have a plurality of projecting formations projecting therefrom into the respective cells. The projecting formations may comprise rib formations that project from the side walls, the rib formations extending substantially parallel to the general plane of the planar body.

According to one particular embodiment of the invention, the multi-cell configuration defined by the planar body is an open-cell configuration in which the cells extend through the body from the operative top face side thereof to the operative bottom side face thereof.

According to a second particular embodiment of the invention, the multi-cell configuration defined by the planar body is a closed-cell configuration, with each cell having a base wall on the operative bottom face side thereof. Each such base wall may define at least one projecting formation that projects operatively upwardly therefrom towards the operative top side of the planar body, each such projecting formation comprising a continuously curved formation that provides its base wall with a continuously curved profile when viewed in section.

Each base wall also may define a plurality of projecting formations that project operatively upwardly therefrom, these projecting formations being arranged to define a plurality of contained spaces within the cell in which they are defined. As such, each cell having a plurality of projecting formations projecting operatively upwardly from the base wall thereof may define an egg-crate configuration.

The operative height of each projecting formation that projects from the base wall of a cell may be between 10% and 50% of the operative depth of the cell. Still further, each base wall may define an opening therein that can serve as a drainage passage for a liquid to drain from the associated cell.

Further according to the invention, the side walls forming the cells defined by the planar body may extend substantially perpendicularly to the general plane of the body. Alternatively, the side walls forming the cells may be configured to define cells that taper from the operative top face side of the planar body to the operative bottom face side of the planar body.

Still further according to the invention, the planar body may define either one of a square and a rectangular outer perimeter profile, rendering similar bodies positionable adjacent one another to form an extended substantially continuous planar structure. It will be appreciated in this regard that alternative outer perimeter profiles also can be provided for that will permit similar bodies to be positioned adjacent one another to form an extended substantially continuous planar structure.

Still further, the planar body may define complementary engagement formations at locations along the outer perimeter thereof that permit inter engagement of similar bodies when placed adjacent one another, to form an extended substantially continuous planar structure.

The cells defined by the planar body may define any one of a square, a rectangular, an angular and a circular profile when viewed in plan view, the overall design of the stabilizing body of the invention in this regard being greatly variable.

The stabilizing body of the invention particularly is formed of a synthetic plastics material by any suitable plastics moulding process. Clearly, the body also can be formed of various other materials.

It is envisaged that the planar body forming the stabilizing body of the invention may comprise a square body having outer dimensions of up to 1.2×1.2 meters, rendering the body relatively easy to manufacture, transport and handle.

Also, the planar body may have a thickness between the top face side thereof and the bottom face side thereof of between 10 mm and 50 mm. This thickness generally will be determined by the requirements of a road to be constructed and may fall outside the above parameters.

For use, a plurality of stabilizing bodies are arranged in an engaged configuration on a preformed base of a road to be constructed, thereby forming an extended continuous stabilizing structure on which a required asphalt composition for forming a wearing course can be applied. To secure the location of the stabilizing bodies, anchoring means may be provided for, it being envisaged in particular that each stabilizing body may define one or more formation that can cooperate with an anchoring element for anchoring the stabilizing body on the base of the road to be constructed. An asphalt composition layer can then be applied on the stabilizing structure formed, the asphalt composition particularly filling the cells forming the multi-cell configuration defined by the planar body of each stabilizing body, while extending above the stabilizing structure, the operative thickness of the stabilizing structure typically comprising between 30% and 60% of the operative thickness of the layer being formed of the asphalt composition. By filling the cells of the stabilizing bodies, the asphalt composition will, in effect, mechanically engage each stabilizing body via the projecting formations projecting from the side walls defining the cells, or via any alternative forms of anchoring formations, thus creating an effectively integrated wearing course.

Clearly, the above parameters are greatly variable and are determined particularly by the requirements of a road being constructed. Also, the mode of application of the asphalt composition may be essentially conventional and its application may be followed by a rolling process for the compaction thereof. It must be appreciated that the above application of stabilizing bodies applies particularly to roads provided with a relatively thin asphalt composition layer, e.g. between 30 mm and 60 mm and that different parameters and arrangements can be provided for roads that have a relatively thick asphalt composition layer, e.g. in the order of 150 mm.

For a road having such a thick asphalt composition layer, a layer of stabilizing bodies with cells having base walls can be positioned on the base of such a road. Alternatively, or in addition, a layer of stabilizing bodies can be positioned at a predetermined distance beneath the exposed surface of the asphalt composition layer being formed, e.g. approximately 10 mm to 30 mm beneath the said surface. The layer of stabilizing bodies positioned on the base of the road will serve to reduce reflective cracking and the layer beneath the surface will serve to reduce rutting and thermal cracking, and resulting damage.

The invention extends also to a method of constructing a road, which includes the steps of:

forming a base for the road to be constructed;

forming a stabilizing structure of stabilizing bodies, in accordance with the invention, above the base of the road by positioning the stabilizing bodies in an adjacent configuration with respect to one another; and forming a wearing course of an asphalt composition which fills the cells of the stabilizing bodies and which forms a layer above the stabilizing structure formed of the stabilizing bodies.

Clearly, this method or road construction and, particularly, the location and support of the stabilizing structure, may be greatly variable and may be determined by the requirements of the road being constructed.

The features of the invention are described in more detail hereinafter with reference to the accompanying diagrammatic drawings. In the drawings.

Figure 1:
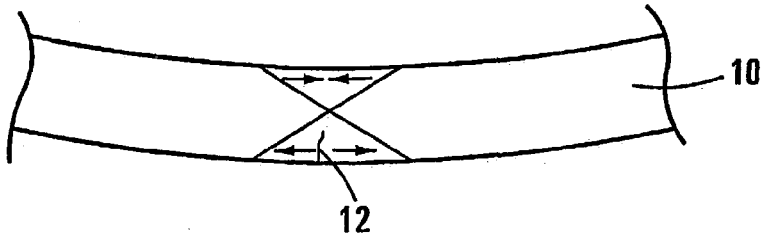
FIG. 1 illustrates in side view the occurrence of reflective cracking within the wearing course of a road, that can cause road failure.
Figure 2:
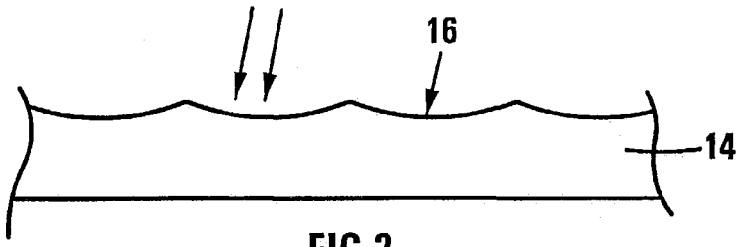
FIG. 2 illustrates in side view the occurrence of road rutting within a road surface.

Referring initially to FIGS. 1 and 2 of the drawings, one common form of road failure involves the failure of the wearing course of a road as a result of reflective cracking, whereas a second form of road failure is associated with deformation of the road surface, being referred to as "rutting" of the road surface. FIG. 1 illustrates in side view the wearing course 10 of a road, particularly when a heavy vehicle passes over the wearing course. As illustrated, with a heavy vehicle passing over the wearing course and due to the load of the vehicle, the wearing course adopts a concave profile in cross-section, resulting in the operative top half of the wearing course to adopt a state of compression, whereas the bottom half of the wearing course will adopt a state of expansion (see the arrows). As a result of such expansion, a reflective crack 12 within the wearing course can occur and as a result of the propagation of such a reflective crack, as well as the propagation of other similarly formed reflective cracks, when further vehicles pass over the road, road failure can occur.

FIG. 2 illustrates a further wearing course 14 of a road, the wearing course 14 having been exposed to heavy vehicles travelling over the wearing course while having been softened as a result of high temperatures. As a result of such softening, the surface 16 of the wearing course 14 has deformed, a corrugated profile as shown having been generated, which is commonly referred to as rutting. Such rutting also can result eventually in complete road failure, whereas rutting also can significantly affect travelling comfort.

Figure 3:
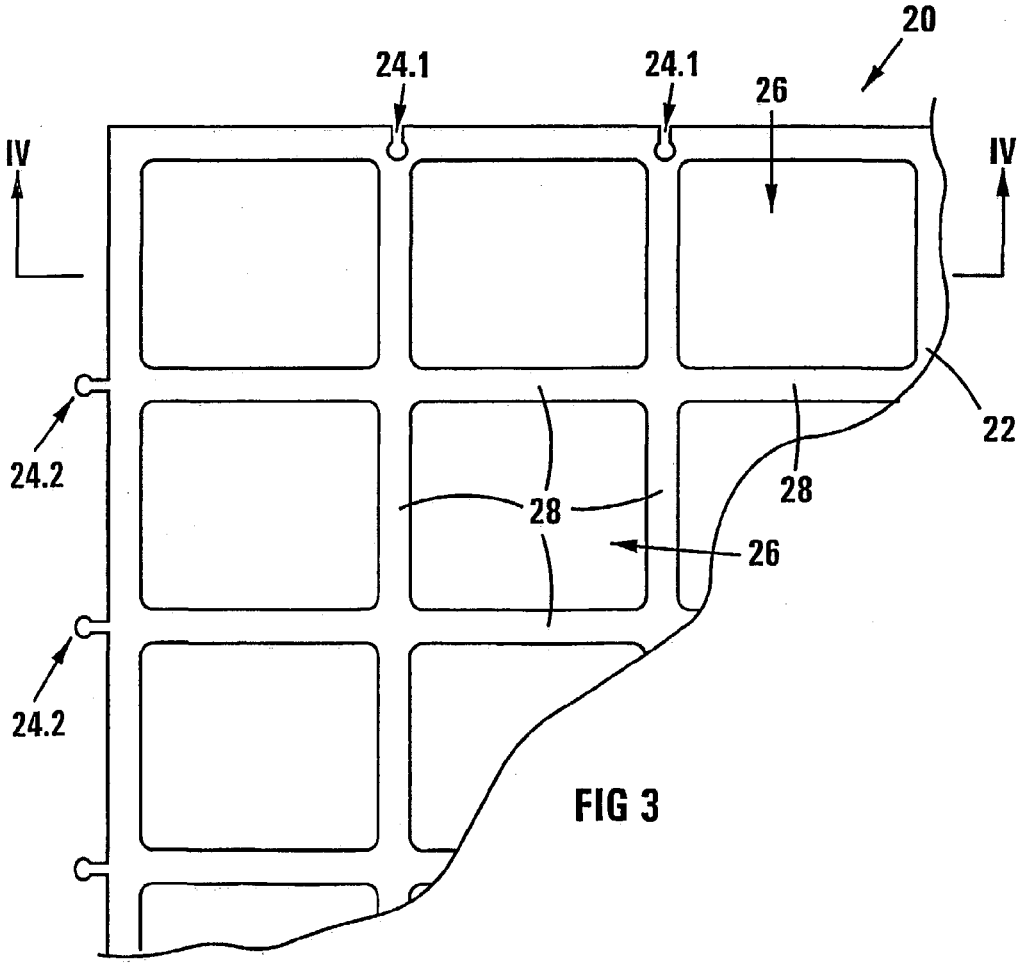
FIG. 3 shows a schematic plan view of a corner region of a first embodiment of a stabilizing body for use in the construction of roads, in accordance with the invention.
Figure 4:
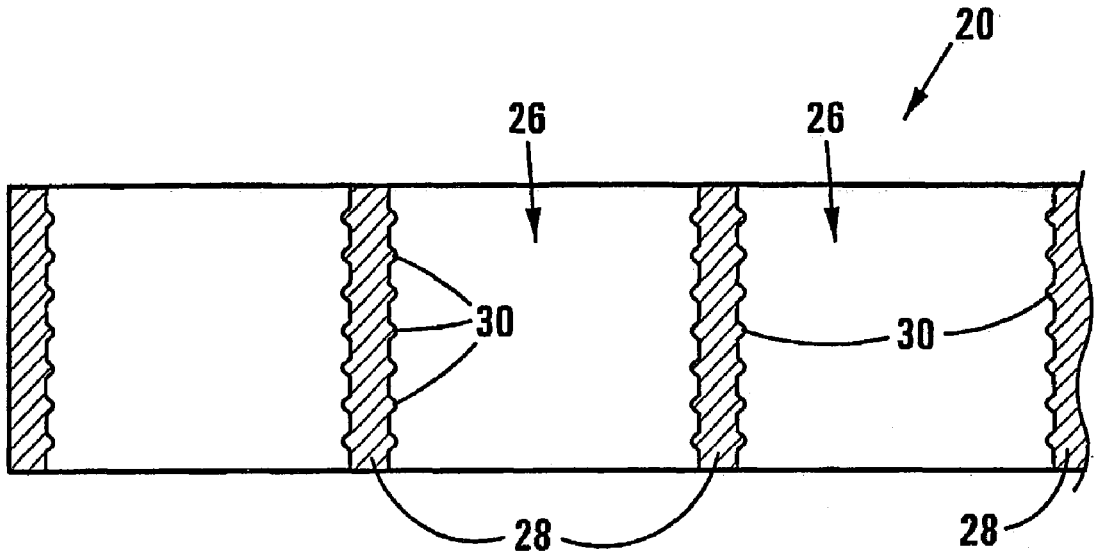
FIG. 4 shows a cross-sectional side view of the portion of the stabilizing body of FIG. 3, along line IV—IV of FIG. 3.

In order to at least reduce reflective cracking and rutting of the wearing course of roads, the construction of roads can be associated with the use of stabilizing bodies, a typical stabilizing body being shown in FIGS. 3 and 4 and being designated generally by the reference numeral 20. The stabilizing body 20 comprises an integrally moulded, substantially planar body 22, of nylon or any other suitable synthetic plastics material, the body 22 defining a substantially square perimeter profile in plan view. The opposite longitudinal edges of the body 22 define complementary engagement formations, 24.1 and 24.2 respectively. The formations 24.1 define recess formations within which the formations 24.2 are snugly receivable, thereby permitting the inter-engagement of similar stabilizing bodies by the formations 24 of adjacent bodies engaging one another. Through the inter-engagement of a plurality of similar stabilizing bodies, an extended stabilizing structure can be formed (see FIG. 10), this aspect of the invention being described in more detail hereafter.

The planar body 22 defines an open cellular structure with individual cells 26 extending through the body from the operative top face side thereof to the operative bottom side thereof. The cells 26 are thus defined by side walls 28, all the side walls 28 defining a plurality of projecting rib formations 30 projecting therefrom (see FIG. 4), the rib formations extending substantially parallel to the general plane of the planar body 22.

The mode of use of stabilizing bodies 20 in the construction of roads, in accordance with the invention, is described in more detail hereafter, with reference also to a second embodiment stabilizing body, in accordance with the invention, that is illustrated in FIGS. 5 to 8 of the drawings.

Referring particularly to FIGS. 5 to 8 of the drawings, a second embodiment stabilizing body for use in the construction of roads, in accordance with the invention, is designated generally by the reference numeral 40. The stabilizing body 40 again comprises an integrally moulded, substantially planar body 42, of nylon or a suitable synthetic plastics material, the body defining a substantially square perimeter profile in plan view (see FIG. 5). The opposite longitudinal edges of the body 42 again define complementary engagement formations, 44.1 and 44.2 respectively, these formations extending around the entire perimeter of the body 42, as shown. The formations 44.2 define recess formations within which the formations 44.1 are snugly receivable, thereby permitting the inter-engagement of similar stabilizing bodies with the formations 44 of adjacent bodies engaging one another in a dovetail-like fashion. Through the inter-engagement of a plurality of similar stabilizing bodies 40, an extended stabilizing structure can again be formed (see FIG. 10), this aspect of the invention being described in more detail hereafter.

The planar body 42 again defines a multi-cellular structure, the body 12 particularly defining a plurality of open-topped cells 46 which extend between the operative top face side and the operative bottom face side of the body 42, the operative bottom end of each cell 46 being blocked by a base wall 48. Although each base wall may merely comprise a substantially planar wall, the particular embodiment stabilizing body 40 provides for each base wall 48 itself to define a plurality of operatively upwardly projecting formations 50 defining contained spaces between them, as is illustrated clearly in FIGS. 6 and 8 of the drawings. The effective height of the formations 50 typically is between 10% and 50% of the operative depth of the cells 46.

The side walls 49 defining the cells 46, in the particular embodiment of the invention as shown in FIGS. 4 to 8, are inclined as shown, thus defining cells 46 that taper from the operative top end thereof towards the base wall 48 thereof, although it must be appreciated in this regard that the exact configuration of the cells of a stabilizing body, in accordance with the invention, is greatly variable. The cells 46 as shown define essentially a square profile when viewed in plan view, but it must be appreciated in this regard that the cells also can define any other perimeter profile, e.g. a circular profile, a hexagonal profile, or the like. Different profile cells can be arranged with respect to one another in an arrangement in which an equivalent configuration to that shown in FIG. 4 is provided for and it will be understood that the same applies also to the stabilizing body 20 as shown in FIGS. 3 and 4 of the drawings.

Figure 9:
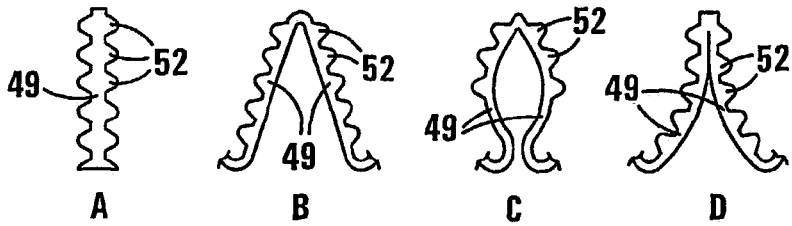
FIG. 9 illustrates different sidewall profiles of the side walls that define the cells of a stabilizing body, in accordance with the invention.

The side walls 49 defining the cells 46 have projections in the form of rib formations 52 projecting therefrom (not illustrated in FIGS. 5 to 8 of the drawings for the sake of clarity). FIG. 9 of the drawings illustrates four different configuration side walls that can be associated with the stabilizing body 40 of the invention. FIGS. 9A, 9B, 9C and 9D thus illustrate side walls 49 that define a plurality of substantially parallel, adjacent rib formations 52 that will project into the interior of the cells with which they are associated. It will thus be appreciated in this regard that the overall configuration of the side walls 49 defining the cells 46 of a stabilizing body 40 is greatly variable and that the configuration of the side walls 28 associated with the stabilizing body 20 as shown in FIGS. 3 and 4, can be similarly variable.

Figure 5:
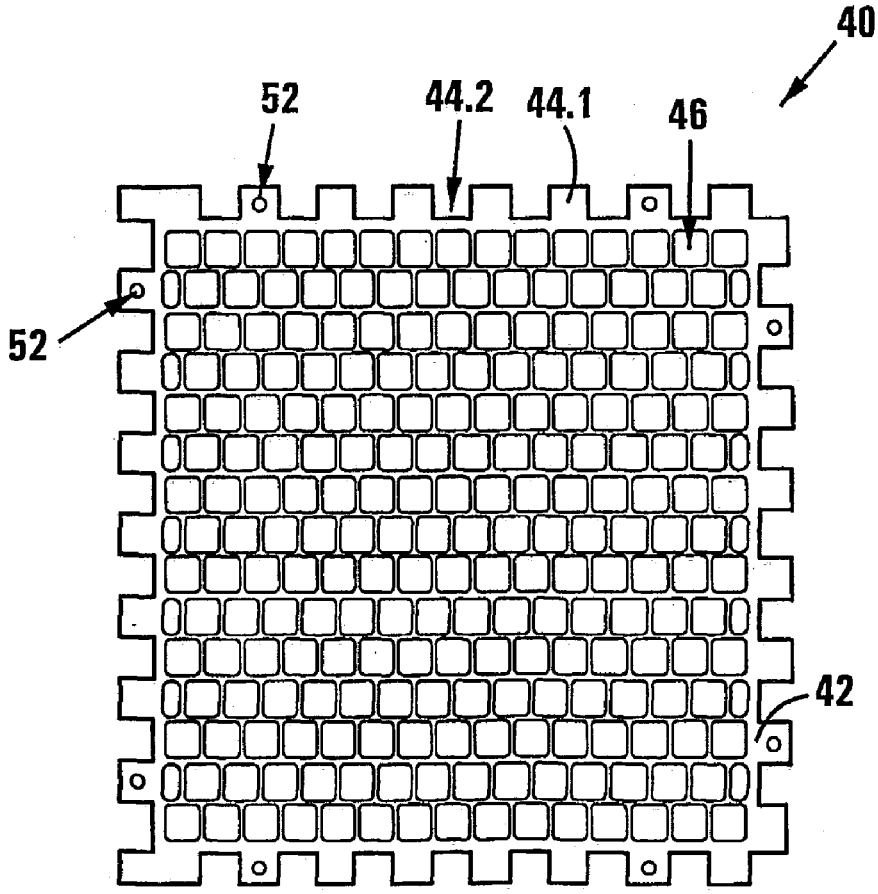
FIG. 5 shows a schematic plan view of a second embodiment of a stabilizing body for use in the construction of roads, in accordance with the invention.
Figure 6:
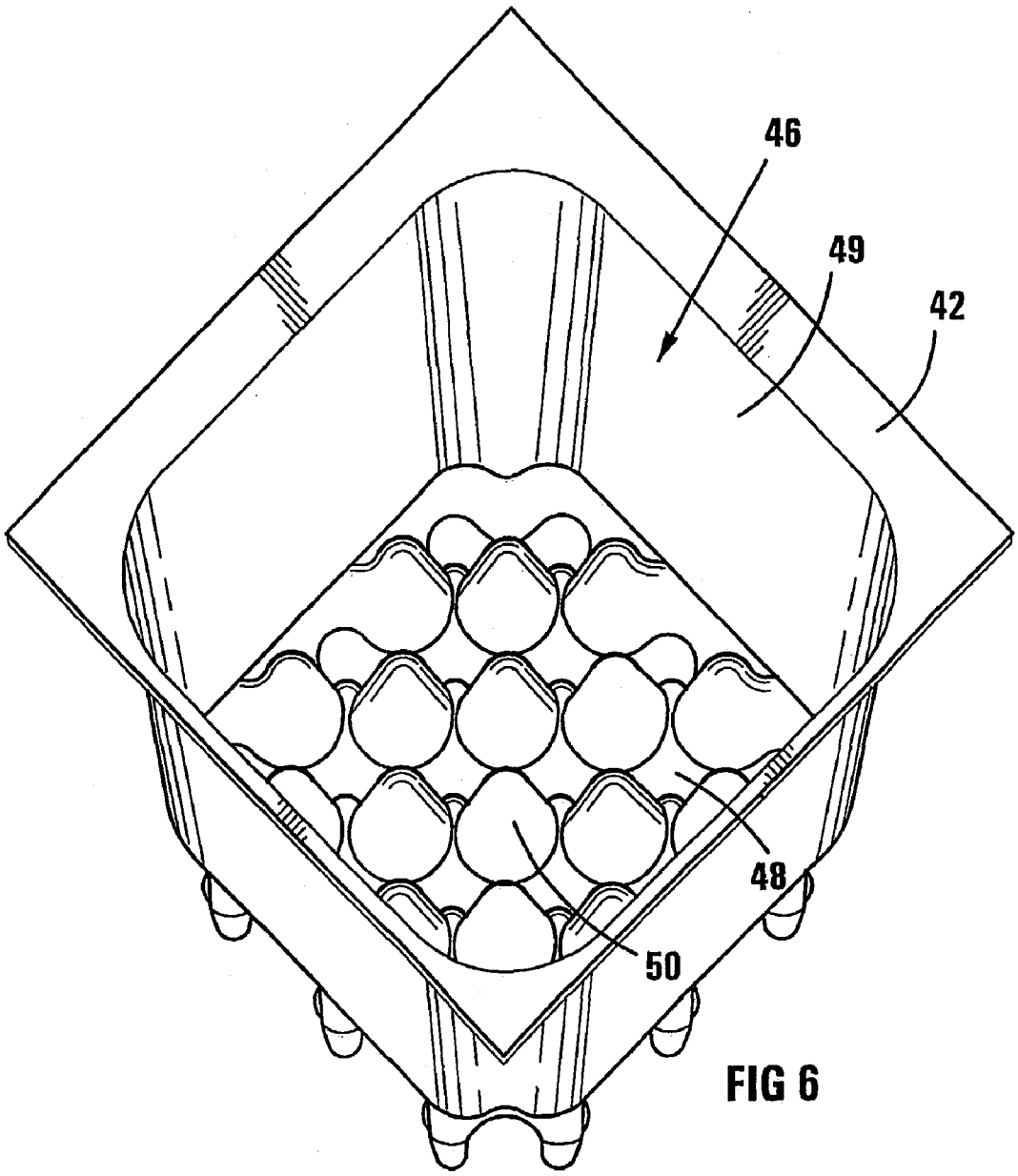
FIG. 6 shows a detailed three-dimensional view of a cell defined by the stabilizing body of FIG. 5.
Figure 7:
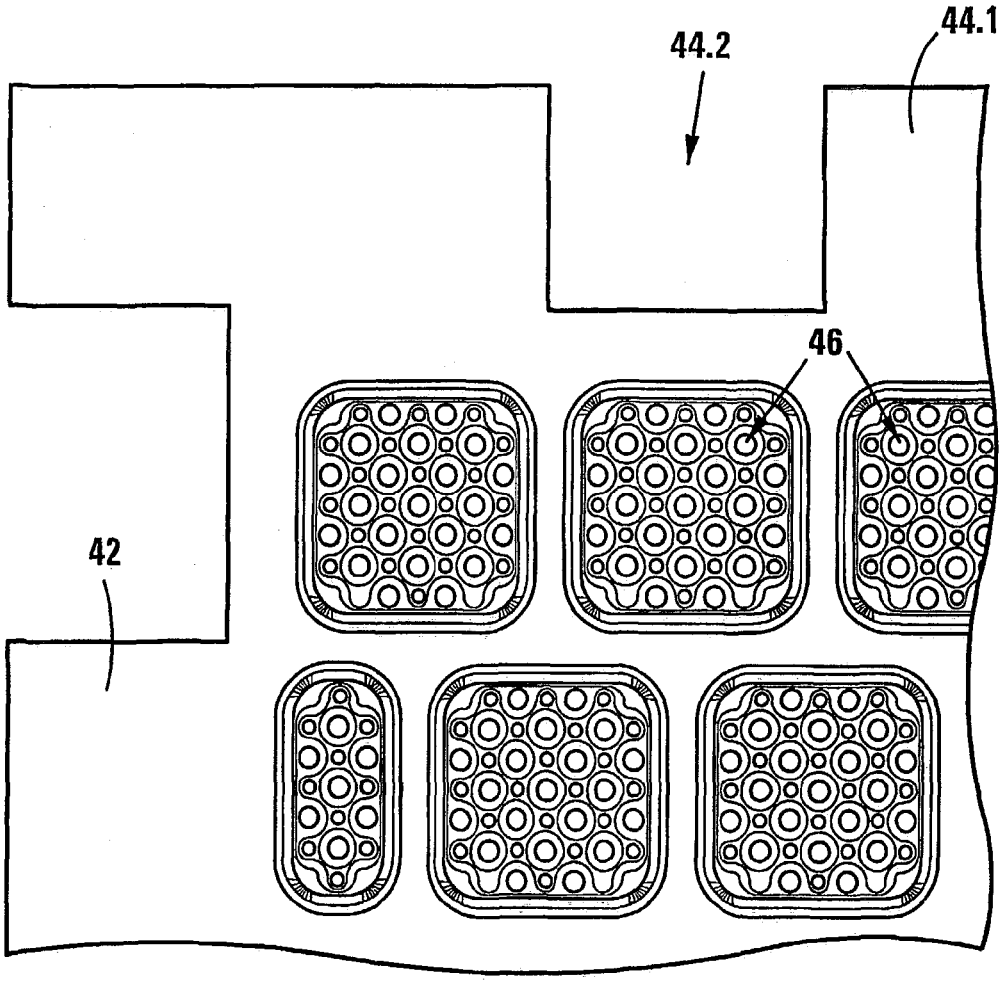
FIG. 7 shows a detailed plan view of a corner segment of the stabilizing body of FIG. 5.
Figure 8:
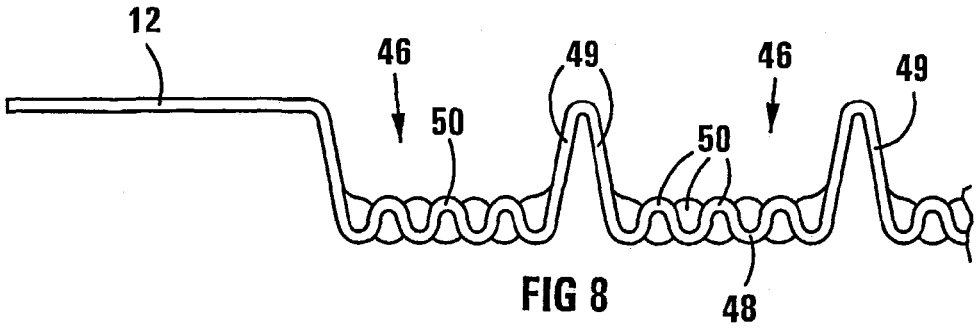
FIG. 8 shows a detailed cross-sectional view of the detailed segment of the stabilizing body as shown in FIG. 7.

As illustrated in FIG. 5 of the drawings, anchoring holes 52 are defined in selected formations 44.1, near the corners of the planar body 42, the anchoring holes permitting anchoring of the stabilizing body on a support base, typically by means of metal stakes, or the like.

Drainage holes also may be provided within the base walls 48 associated with the cells associated with the planar body 42 of the stabilizing body 40, for permitting the passage of a liquid through the body 42. It will again be appreciated that many different configuration anchoring formations can be associated with the location of stabilizing bodies on the base of a road to be constructed, providing particularly also for the secure location of stabilizing bodies of both the types 20 and 40 as described.

Figure 10:
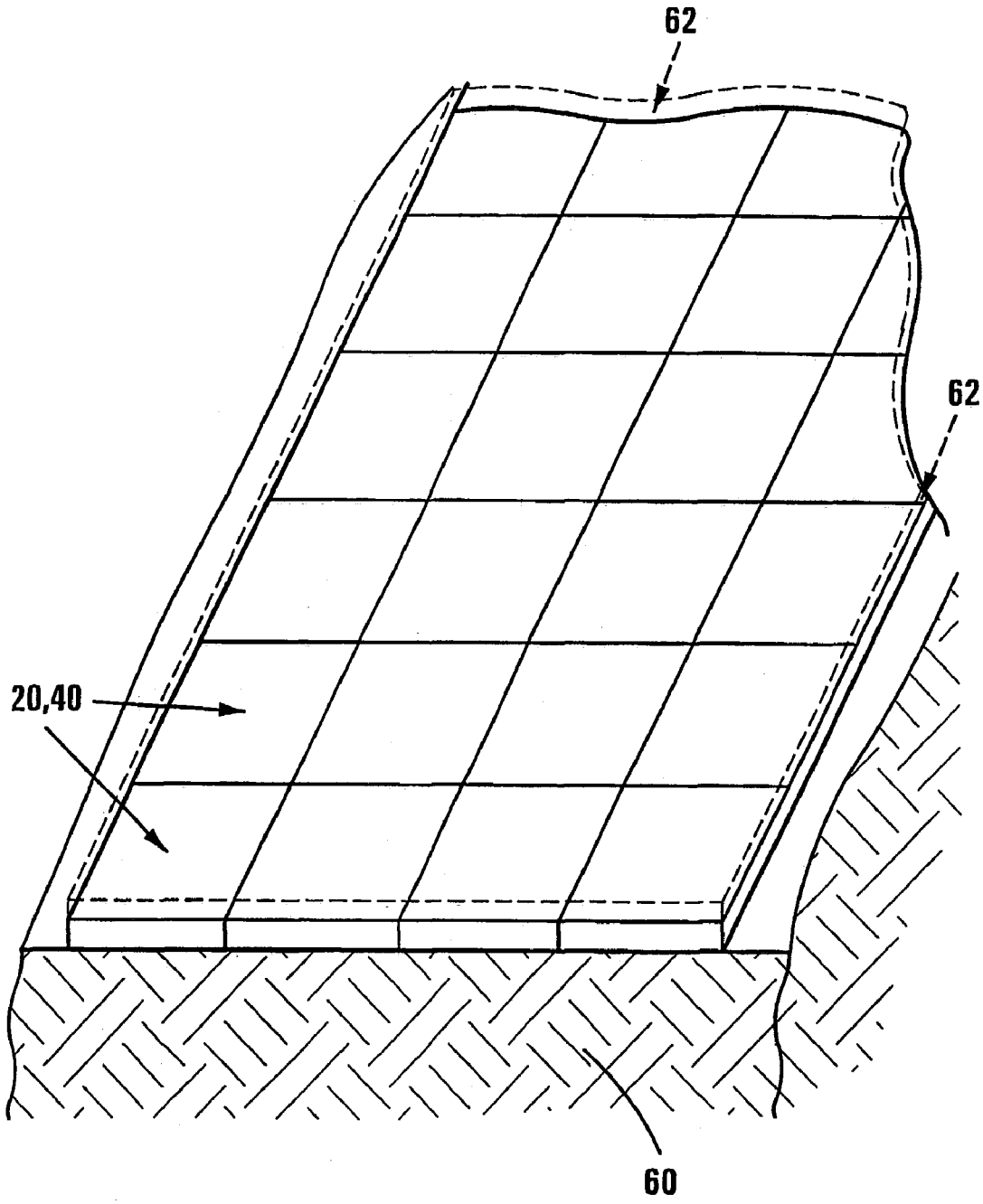
FIG. 10 illustrates schematically in three dimensional view the method of constructing a road in accordance with the invention.

For use, and referring particularly also to FIG. 10 of the drawings, a plurality of stabilizing bodies 20, 40, through their inter-engagement, can form an extended stabilizing structure that can cover the entire base for a road to be constructed, the cells defined by the stabilizing bodies all being open on the operative top side thereof so that the asphalt composition for forming the wearing course of the road to be constructed, when applied on the stabilizing structure, will fill the said cells and form a continuous layer above the stabilizing structure. FIG. 10 illustrates a typical stabilizing structure formed on a stable base 60 for a road, the stable base 60 being formed in any conventional manner. After the location of the stabilizing structure through the inter-engagement of a plurality of stabilizing bodies 20, 40 and anchoring of the bodies to the base 60, an asphalt composition layer 62 (only shown in dotted lines) of an asphalt composition is applied on the stabilizing structure, filling the cells defined by the individual stabilizing bodies and forming a continuous layer above the stabilizing bodies, it being envisaged in particular that the total thickness of the asphalt composition layer 62 will be approximately two times the effective thickness of the stabilizing structure, as defined by the stabilizing bodies.

The application method of the asphalt composition can be conventional and the layer formed can also be compacted in a conventional manner for finally forming a stable wearing course. It will be appreciated in the above regard that the overall method of constructing a road, including the formation of an asphalt composition layer as envisaged above, can be associated with various other steps and processes that are commonly associated with the construction of roads.

By the provision of the stabilizing structure, water seepage, that could otherwise cause a asphalt composition layer to lift and break-up is effectively dealt with, while the stability provided within the asphalt composition layer, by being partially accommodated within the stabilizing structure, will reduce material movement that could otherwise occur as a result of softening of the tar component of the asphalt composition material when exposed to elevated temperatures. Particularly in relation to the stabilizing bodies 40, the contained spaces between projections 50 defined by the base walls 48 of individual cells 46 also serve to contain the asphalt composition material therein and in effect serve to dissipate the tensile stresses within the material layer when a road surface is exposed to heavy loads, thereby reducing the possibility of reflective cracking developing, which is also commonly associated with asphalt layer break-up. The same applies clearly to the use of the stabilizing bodies 20. By reducing or eliminating reflective cracking, the possible propagation of cracks formed and that can eventually result in break-up, is thus greatly reduced, providing for a more stable road surface having a longer life.

The rib formations 30, 52 associated with the respective forms of stabilizing bodies 20, 40, serve to anchor the asphalt composition within the cells, while also serving to dissipate loads and, as such, reduce the possibility of reflective cracking occurring.

Figure 11:
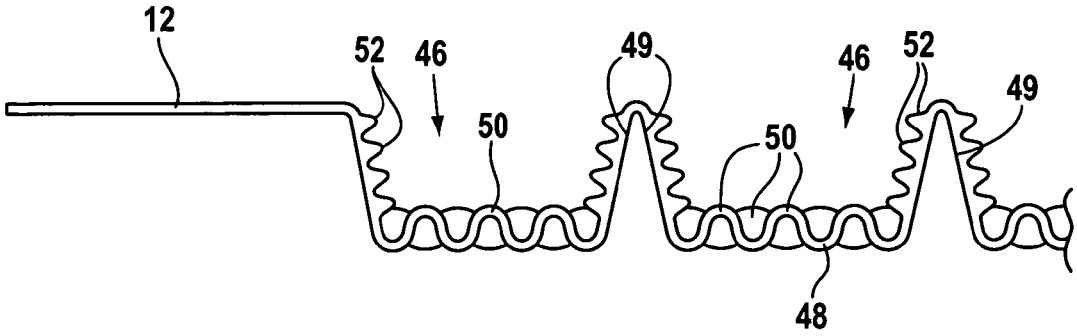
FIG. 11 illustrates a sidewall profile of cell having both upwardly projecting projections forming a continuously curved base and rib formations that define the cells of another stabilizing body, in accordance with the invention.

In FIG. 11 there is illustrated several cells 46 of a stabilizing body 40 which has both upwardly projecting projections 50 providing a continuously curved base and side walls 49 with projecting rib formations 52.

The use of stabilizing bodies within the construction of roads as above described particularly provides for the construction of roads having an asphalt composition layer that is relatively thin, for example between 30 mm and 60 mm. However, it is envisaged that stabilizing bodies can be used in conjunction with roads having significantly thicker asphalt composition layers, up to 150 mm, or the like. For the latter application, open cell stabilizing bodies 20 can be utilized a predetermined distance between the exposed road surface of the road being formed, these bodies thus being spaced from the base of the road. The stabilizing bodies can be effective to reduce potential rutting. A further stabilizing structure formed of stabilizing bodies having closed cells can then additionally be placed upon the base of such roads, these particular stabilizing bodies serving particularly to reduce reflective cracking.

It must be appreciated in the above regard that the mode of use of stabilizing bodies within the construction of roads and also for the repair of roads is greatly variable. In order to obtain optimum results within the construction of a road and particularly in order to obtain optimum qualities for the asphalt composition layer of a road forming the wearing course of the road, the optimum configuration of stabilizing bodies must be established, particularly through experimentation. The main objective clearly will be to deal with water, reflective cracking, rutting, thermal cracking, and the like.

The Applicant believes that with the use of stabilizing bodies as proposed, a road having a substantially longer life will be provided for, thus in the long term effectively reducing the cost associated with the construction and maintenance of roads. For different applications, the specific design and construction of stabilizing bodies can be greatly varied and the invention extends also to such different configuration stabilizing bodies which will still incorporate the essential principles of the invention as herein defined. It is envisaged still further that stabilizing bodies may define flow paths for leading away water from beneath the asphalt composition layer of a road, which is required in order to ensure that this asphalt composition layer cannot lift from its base and thereby break-up.

The stabilizing bodies of the invention may also be selectively used within road construction, for example in road segments that are excessively exposed to traffic and/or to heavy traffic, such as in road intersections, and the like. Stabilizing bodies also are particularly suitable for use in conjunction with road maintenance which invariably is associated with areas of road that are naturally unstable. Stabilizing bodies also can be used for various other applications where the provision of a road-like surface, or other suitable surface, is required and potentially also with the construction of roads that are not specifically asphalt roads, but where stabilizing bodies can serve to stabilize the upper material layer of the road that forms the road surface. Any reference herein to asphalt roads and asphalt compositions must be interpreted accordingly.

What is claimed is:

1. A stabilizing body for use in the construction of asphalt roads, which comprises a substantially rigid, planar body defining a multi-cell configuration between spaced operative top and bottom sides of the planar body, and in which the cells are defined by surrounding side walls extending from the operative top side of the body towards the operative bottom side of the body and the side walls of each cell have a plurality of projecting, continuously curved, rib formations that project therefrom, without sharp corners that can induce reflective cracks, into the space defined by the cell and that extend substantially parallel to the general plane of the body, the rib formations, in use of stabilizing body, serving to anchor an asphalt composition that is received in the cells for forming a road surface within the cells.

2. A stabilizing body as claimed in claim 1, in which the cells, forming the multi-cell configuration defined by the planar body, each have a base wall that at least partially blocks the cell on the operative bottom side of the planar body.

3. A stabilizing body as claimed in claim 2, in which each base wall defines at least one projecting formation that projects operatively upwardly therefrom towards the operative top side of the planar body, each such projecting formation comprising a continuously curved formation that provides its base wall with a continuously curved profile when viewed in section.

4. A stabilizing body as claimed in claim 3, in which the operative height of the projecting formation that projects from the base wall of a cell is between 10% and 50% of the operative depth of the cell.

5. A stabilizing body as claimed in claim 1, in which the multi-cell configuration defined by the planar body is an open-cell configuration in which the cells extend through the body from the operative top side thereof to the operative bottom side thereof.

6. A stabilizing body as claimed in claim 3, in which each base wall defines a plurality of projecting formations that project operatively upwardly thereform and that are arranged to define a plurality of contained spaces within the cell in which they are defined.

7. A stabilizing body as claimed in claim 6, in which each cell having a plurality of projecting formations projecting operatively upwardly from the base wall thereof defines an egg-crate configuration.

8. A stabilizing body as claimed in claim 6, in which the operative height of each projecting formation that projects from the base wall of a cell is between 10% and 50% of the operative depth of the cell.

9. A stabilizing body as claimed in claim 2, in which each base wall defines an opening therein that can serve as a drainage passage for a liquid to drain from the associated cell.

10. A stabilizing body as claimed in claim 1, in which the side walls forming the cells defined by the planar body extend substantially perpendicularly to the general plane of the planar body.

11. A stabilizing body as claimed in claim 1, in which the side walls forming the cells are configured to define cells that taper from the operative top face side of the planar body to the operative bottom face side of the planar body.

12. A stabilizing body as claimed in claim 1, in which the planar body defines either one of a square and a rectangular outer perimeter profile, rendering similar bodies position able adjacent one another to form an extended substantially continuous planar structure.

13. A stabilizing body as claim in claim 1, in which the planar body defines complementary engagement formations at locations along the outer perimeter thereof that permit inter-engagement of similar bodies when placed adjacent one another, to form an extended substantially continuous planar structure.

14. A stabilizing body as claimed in claim 1, which is formed of a synthetic plastics material.

15. A stabilizing body as claimed in claim 1, in which the planar body comprises a square body having outer dimensions of up to 1.2×1.2 meters.

16. A stabilizing body as claimed in claim 1, in which the planar body has a thickness between the top side thereof and the bottom side thereof between 10 mm and 50 mm.

* * * * *

UNITED STATES PATENT AND TRADEMARK OFFICE

CERTIFICATE OF CORRECTION

PATENT NO. : 7,001,102 B2
APPLICATION NO. : 10/603873
DATED : February 21, 2006
INVENTOR(S) : David Peter Dennison It is certified that error appears in the above-identified patent and that said Letters Patent is hereby corrected as shown below:

On the title page, item:

"(30) Foreign Application Priority Data

Jan. 8, 2001 (ZA) ..... 01/0188
Jan. 4, 2002 (WO) ..... 02/053840"

should be

--related U.S. Application Data

(63) Continuation of Application No. PCT/IB02/00005, filed on January 4, 2002.

(30) Foreign Application Priority Data

Jan. 8, 2001 (ZA) ..... 01/0188--

Column 9 & 10; Claim 12 lines 3 and 4 "position able" should be

--positionable--

Column 10; Claim 13 line 1 first occurrence change "claim" should be

--claimed--

Signed and Sealed this

Second Day of February, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,001,102 B2
APPLICATION NO. : 10/603873
DATED : February 21, 2006
INVENTOR(S) : David Peter Dennison It is certified that error appears in the above-identified patent and that said Letters Patent is hereby corrected as shown below:

On the title page, item:

"(30) Foreign Application Priority Data

Jan. 8, 2001 (ZA) ..... 01/0188
Jan. 4, 2002 (WO) ..... 02/053840"

should be

--Related U.S. Application Data

(63) Continuation of Application No. PCT/IB02/00005, filed on January 4, 2002.

(30) Foreign Application Priority Data

Jan. 8, 2001 (ZA) ..... 01/0188--

Column 9, line 19 - Column 10, line 1; Claim 12 "position able" should be

--positionable--

Column 10, line 3; Claim 13 first occurrence change "claim" should be

--claimed--

This certificate supersedes the Certificate of Correction issued February 2, 2010.

Signed and Sealed this

Twenty-third Day of February, 2010

David J. Kappos

David J. Kappos
*Director of the United States Patent and Trademark Office*